US010912391B2

(12) United States Patent
Wang et al.

(10) Patent No.: US 10,912,391 B2
(45) Date of Patent: Feb. 9, 2021

(54) KNOCKDOWN ADJUSTABLE BED WITH A SLIDABLE ASSEMBLY

(71) Applicant: Nisco Co., Ltd, Jiangsu (CN)

(72) Inventors: Wei Wang, Jiangsu (CN); Jian Xie, Jiangsu (CN); Yifan Mao, Jiangsu (CN)

(73) Assignee: NISCO CO., LTD, Jiangsu (CN)

( * ) Notice: Subject to any disclaimer, the term of this patent is extended or adjusted under 35 U.S.C. 154(b) by 0 days.

(21) Appl. No.: 16/505,856

(22) Filed: Jul. 9, 2019

(65) Prior Publication Data

US 2020/0214461 A1 Jul. 9, 2020

Related U.S. Application Data

(60) Provisional application No. 62/789,047, filed on Jan. 7, 2019.

(51) Int. Cl.

| | |
|---|---|
| ***A47C 20/04*** | (2006.01) |
| ***A47C 20/08*** | (2006.01) |
| ***A61G 7/015*** | (2006.01) |
| ***A61G 7/018*** | (2006.01) |
| ***A61G 13/08*** | (2006.01) |
| ***A61G 7/05*** | (2006.01) |

(52) U.S. Cl.

CPC ..... *A47C 20/041* (2013.01); *A47C 20/08* (2013.01); *A61G 7/015* (2013.01); *A61G 7/018* (2013.01); *A61G 7/0506* (2013.01); *A61G 7/0508* (2016.11); *A61G 13/08* (2013.01); *A61H 2201/0142* (2013.01)

(58) Field of Classification Search

CPC ..... A61G 7/002; A61G 7/005; A61G 7/012; A61G 7/015; A61G 7/018; A61G 13/02; A61G 13/04; A61G 13/06; A61G 13/08; A47C 20/04; A47C 20/041; A47C 20/08

USPC ..... 5/618, 613, 616, 617, 611, 610, 600

See application file for complete search history.

(56) References Cited

U.S. PATENT DOCUMENTS

| | | | | |
|---|---|---|---|---|
| 6,006,379 A * | 12/1999 | Hensley | ..... | A47C 20/041 5/616 |
| 6,101,647 A * | 8/2000 | Stroud | ..... | A47C 20/041 5/613 |
| 6,209,157 B1 * | 4/2001 | Hensley | ..... | A47C 20/041 5/613 |
| 6,216,295 B1 * | 4/2001 | Pearson | ..... | A47C 20/041 5/613 |

(Continued)

*Primary Examiner* — Robert G Santos

(74) *Attorney, Agent, or Firm* — Locke Lord LLP; Tim Tingkang Xia, Esq.

(57) ABSTRACT

An adjustable bed includes: a head frame assembly; a foot frame assembly; a knockdown connecting bracket; a slidable assembly having a pair of slidable assembly sides slidable within a pair of lower C steel brackets in a slidable assembly upward direction or a slidable assembly downward direction; a plurality of slidable assembly angle steels; a pair of head lift arm bracket assemblies; a second head tilt angle bracket; a head tilt platform; a head lift platform; a lumbar lift bracket assembly; an upper seat platform; a support platform; a lower seat platform; a head lift motor, secured to the head frame assembly for driving the pair of head lift arm bracket assemblies in a head lift forward direction or a head lift backward direction; and a head support tube, having an upper end pivotally connected to a L bracket and a lower end connected to the head lift platform.

15 Claims, 8 Drawing Sheets

(56) References Cited

U.S. PATENT DOCUMENTS 6,276,011 B1 * 8/2001 Antinori ..... A47C 20/041 5/613
6,393,641 B1 * 5/2002 Hensley ..... A47C 20/041 5/613
6,708,358 B2 * 3/2004 Hensley ..... A47C 20/041 5/613
6,874,182 B2 * 4/2005 L'Hegarat ..... A61G 13/08 5/612
7,089,612 B2 * 8/2006 Rocher ..... A61G 13/08 5/600
7,448,100 B1 * 11/2008 Shih ..... A61G 7/015 5/600
7,530,125 B2 * 5/2009 Neuenswander .... A47C 20/041 5/616
7,698,761 B2 * 4/2010 Neuenswander .... A47C 31/008 5/618
7,849,539 B2 * 12/2010 Hornbach ..... A61G 7/015 5/618
7,900,302 B2 * 3/2011 Long ..... A47C 20/08 5/618
8,683,629 B2 * 4/2014 Clenet ..... A61G 7/015 5/613
9,049,942 B2 * 6/2015 Huang ..... A47C 20/041
9,642,757 B2 * 5/2017 Sheppard ..... A47C 19/045
9,706,848 B2 * 7/2017 Shih ..... A61G 7/015
10,350,122 B2 * 7/2019 Liu ..... A61G 7/018
10,398,234 B2 * 9/2019 Chung ..... A47C 19/021
10,660,446 B2 * 5/2020 Chung ..... A47C 20/04
2001/0000828 A1 * 5/2001 Hensley ..... A47C 20/08 5/618
2004/0083549 A1 * 5/2004 L'Hegarat ..... A61G 13/08 5/621
2006/0080777 A1 * 4/2006 Rocher ..... A61G 13/08 5/618
2008/0148484 A1 * 6/2008 Hornbach ..... A61G 7/018 5/601
2009/0019640 A1 * 1/2009 Neuenswander ..... A61G 7/015 5/618
2009/0094748 A1 * 4/2009 Long ..... A47C 20/08 5/613
2009/0178201 A1 * 7/2009 Lujan ..... A47C 20/027 5/618
2009/0193587 A1 * 8/2009 Neuenswander .... A47C 31/008 5/618
2009/0211028 A1 * 8/2009 Richmond ..... A47C 20/08 5/618
2013/0019407 A1 * 1/2013 Sheppard ..... A47C 20/041 5/611
2013/0145553 A1 * 6/2013 Shih ..... A47C 7/462 5/624
2014/0000033 A1 * 1/2014 Clenet ..... A61G 7/015 5/618
2014/0250599 A1 * 9/2014 Cassell ..... A61G 7/015 5/613
2015/0040317 A1 * 2/2015 Sheppard ..... A47C 20/041 5/611
2015/0121623 A1 * 5/2015 Huang ..... A61G 7/018 5/616
2016/0361216 A1 * 12/2016 Liu ..... A61G 7/015
2018/0125249 A1 * 5/2018 Chung ..... A47C 19/021
2018/0125252 A1 * 5/2018 Chung ..... A47C 19/025
2020/0214461 A1 * 7/2020 Wang ..... A47C 20/041

* cited by examiner

KNOCKDOWN ADJUSTABLE BED WITH A SLIDABLE ASSEMBLY

CROSS-REFERENCE TO RELATED PATENT APPLICATION

This application claims priority to and the benefit of, pursuant to 35 U.S.C. § 119(e), U.S. provisional patent application Ser. No. 62/789,047, filed Jan. 7, 2019, which is incorporated herein in its entirety by reference.

FIELD OF THE INVENTION

The invention generally relates to a bed, and more particular to a knockdown adjustable bed with a slidable assembly.

BACKGROUND OF THE INVENTION

Beds find widespread use. Adjustable beds are used more and more in healthcare, home improvement scenarios. Recently, electric motors have been applied to adjustable beds to facilitate the movement through the different positions. For such a design, when a upper portion of an adjustable bed is lifted, the person who is lying on the adjustable bed may feel that her abdomen is pressed because the length of the adjustable bed is fixed when the upper portion is lifted.

Therefore, a heretofore unaddressed need exists in the art to address the aforementioned deficiencies and inadequacies.

SUMMARY OF THE INVENTION

The invention, in one aspect, relates to a power operation system with a power headrest operation system and a power lumbar operation system and a chair having the same.

According to one aspect of the invention, an adjustable bed includes a head frame assembly, having a head frame upper rail, a head frame lower rail, and a pair of head frame side rails, each head frame side rail having a lower C steel bracket at a upper end and a higher C steel bracket at a lower end; a foot frame assembly, having a foot frame upper rail, a foot frame lower rail, and a pair of foot frame side rails; a knockdown connecting bracket connecting the head frame lower rail of the head frame assembly and the foot frame upper rail of the foot frame assembly; a L bracket mounted on the head frame upper rail; a slidable assembly having a slidable assembly base and a pair of slidable assembly sides, each of the pair of slidable assembly sides is slidable within one of the pair of lower C steel brackets in a slidable assembly upward direction or a slidable assembly downward direction; a plurality of slidable assembly angle steels mounted on the slidable assembly base; a pair of head lift arm bracket assemblies, a first end of each head lift arm bracket assembly is pivotally connected to one of the pair of slidable assembly sides through one of a pair of rotate pivots, a second end of each head lift arm bracket assembly is connected to one of two ends of a first head tilt angle bracket; a second head tilt angle bracket, hinged with the first head tilt angle bracket through a hinge; a head tilt platform, mounted on the second head tilt angle bracket; a head lift platform, mounted on the first head tilt angle bracket and the pair of head lift arm bracket assemblies; a lumbar lift bracket assembly, pivotally connected to the pair of head lift arm bracket assemblies through a pair of rotate pivots; an upper seat platform, mounted on the slidable assembly; a support platform, mounted on the plurality of slidable assembly angle steels; a lower seat platform, mounted on the higher C steel brackets of the pair of head frame side rails; a head lift motor, secured to the head frame assembly for driving the pair of head lift arm bracket assemblies in a head lift forward direction or a head lift backward direction; and a head support tube, having an upper end pivotally connected to the L bracket and a lower end connected to the head lift platform. When the head lift motor drives the pair of head lift arm bracket assemblies in the head lift forward direction, the slidable assembly slides in the slidable assembly upward direction, and when the head lift motor drives the pair of head lift arm bracket assemblies in the head lift backward direction, the slidable assembly slides in the slidable assembly downward direction and the support platform is partially beneath the lower seat platform.

In some embodiments, the adjustable bed further includes a lumbar motor, secured to the head lift platform for driving the lumbar lift bracket assembly in a lumbar lift forward direction or a lumbar lift backward direction.

In some embodiments, the adjustable bed further includes a head tilt motor, secured to the head lift platform for driving the head tilt platform in a head tilt forward direction or a head tilt backward direction.

In some embodiments, the adjustable bed further includes a welded tube, welded to the first head tilt angle bracket and protruding in parallel with the head lift platform toward the second head tilt angle bracket, preventing the head tilt platform from moving further in the head tilt backward direction when the head tilt platform is in contact with the welded tube.

In some embodiments, the adjustable bed further includes a plurality of rolling wheels, mounted at the pair of slidable assembly sides to roll within one of the pair of lower C steel brackets in the slidable assembly upward direction or the slidable assembly downward direction.

In some embodiments, the adjustable bed further includes: a pair of foot lift arm bracket assemblies, a first end of each foot lift arm bracket assembly is pivotally connected to the foot frame assembly through one of a pair of rotate pivots, a second end of each foot lift arm bracket assembly is a free end; a fixed platform, mounted on the pair of foot frame side rails; a thigh platform, mounted on the pair of foot lift arm bracket assemblies; a leg platform, hinged with the thigh platform through a hinge; a foot lift motor, secured to the foot frame assembly for driving the pair of foot lift arm bracket assemblies in a foot lift forward direction or a foot lift backward direction; and a foot support tube, having an upper end pivotally connected to the foot frame assembly and a lower end connected to the leg platform.

In some embodiments, each of the pair of foot frame side rails has a higher C steel bracket.

In some embodiments, the adjustable bed further includes: a first opening for motor in the lower seat platform to accommodate the head lift motor; a second opening for the motor in the head lift platform to accommodate the head tilt motor; and a third opening for the motor in the head lift platform to accommodate the lumbar motor.

In some embodiments, the adjustable bed further includes: a fourth opening for motor in the leg platform to accommodate the foot lift motor; and a fifth opening for the motor in the thigh platform to accommodate the foot lift motor.

In some embodiments, the adjustable bed further includes a first massage motor opening hole in the head lift platform.

In some embodiments, the adjustable bed further includes a second massage motor opening hole in the leg platform.

In some embodiments, the adjustable bed further includes a plurality of head support platform mounting bracket mounted on the head frame upper rail of the head frame assembly.

In some embodiments, the adjustable bed further includes a plurality of foot support platform mounting bracket mounted on the foot frame lower rail of the foot frame assembly.

In some embodiments, the head lift motor, the head tilt motor, the lumbar motor and the foot lift motor are linear actuators.

These and other aspects of the invention will become apparent from the following description of the preferred embodiment taken in conjunction with the following drawings, although variations and modifications therein may be affected without departing from the spirit and scope of the novel concepts of the disclosure.

BRIEF DESCRIPTION OF THE DRAWINGS

The accompanying drawings illustrate one or more embodiments of the invention and, together with the written description, serve to explain the principles of the invention. Wherever possible, the same reference numbers are used throughout the drawings to refer to the same or like elements of an embodiment.

DETAILED DESCRIPTION OF THE INVENTION

Figure 1:
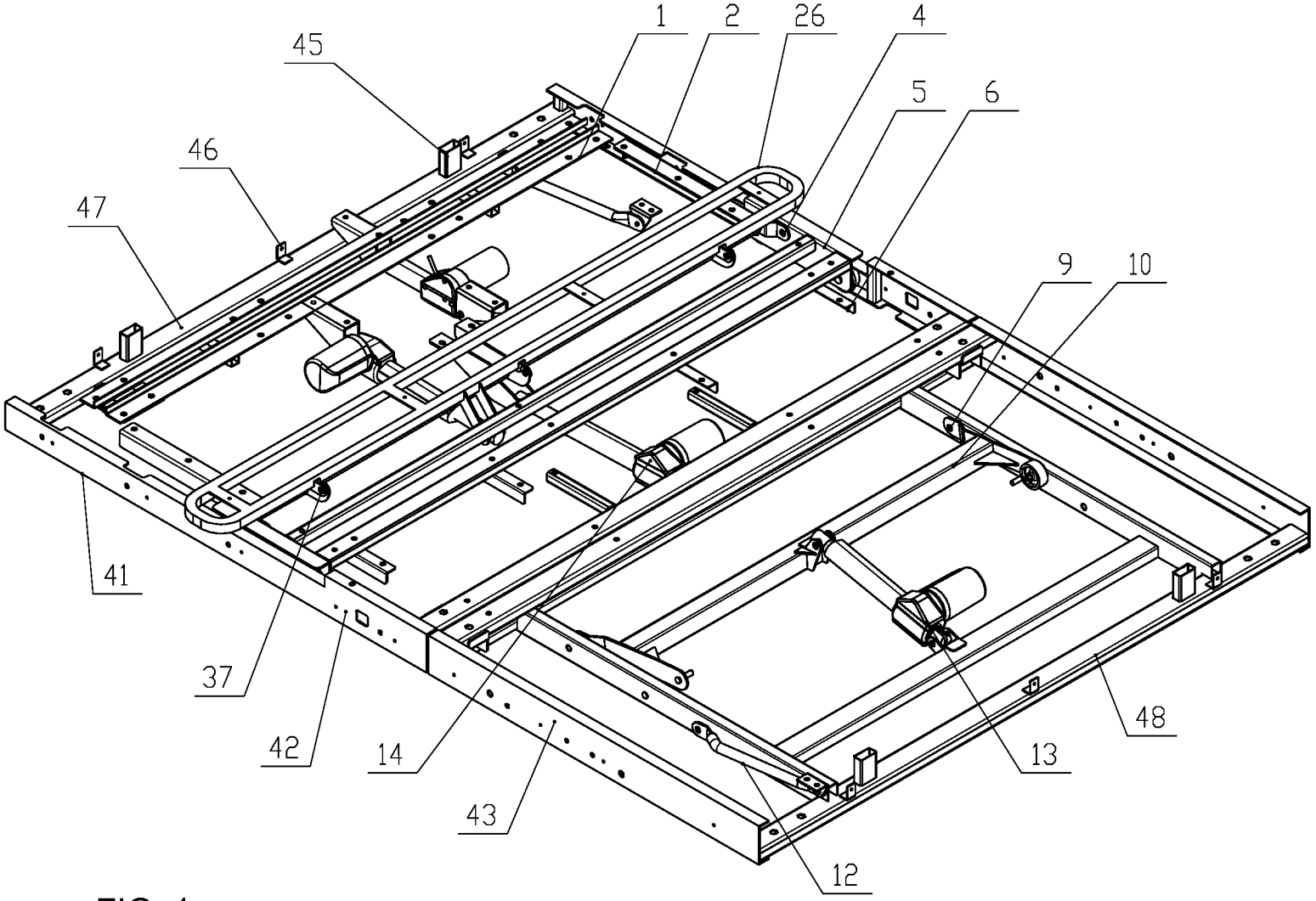
FIG. 1 shows schematically a front perspective view of a structural frame of an adjustable bed according to one embodiment of the invention.
Figure 2:
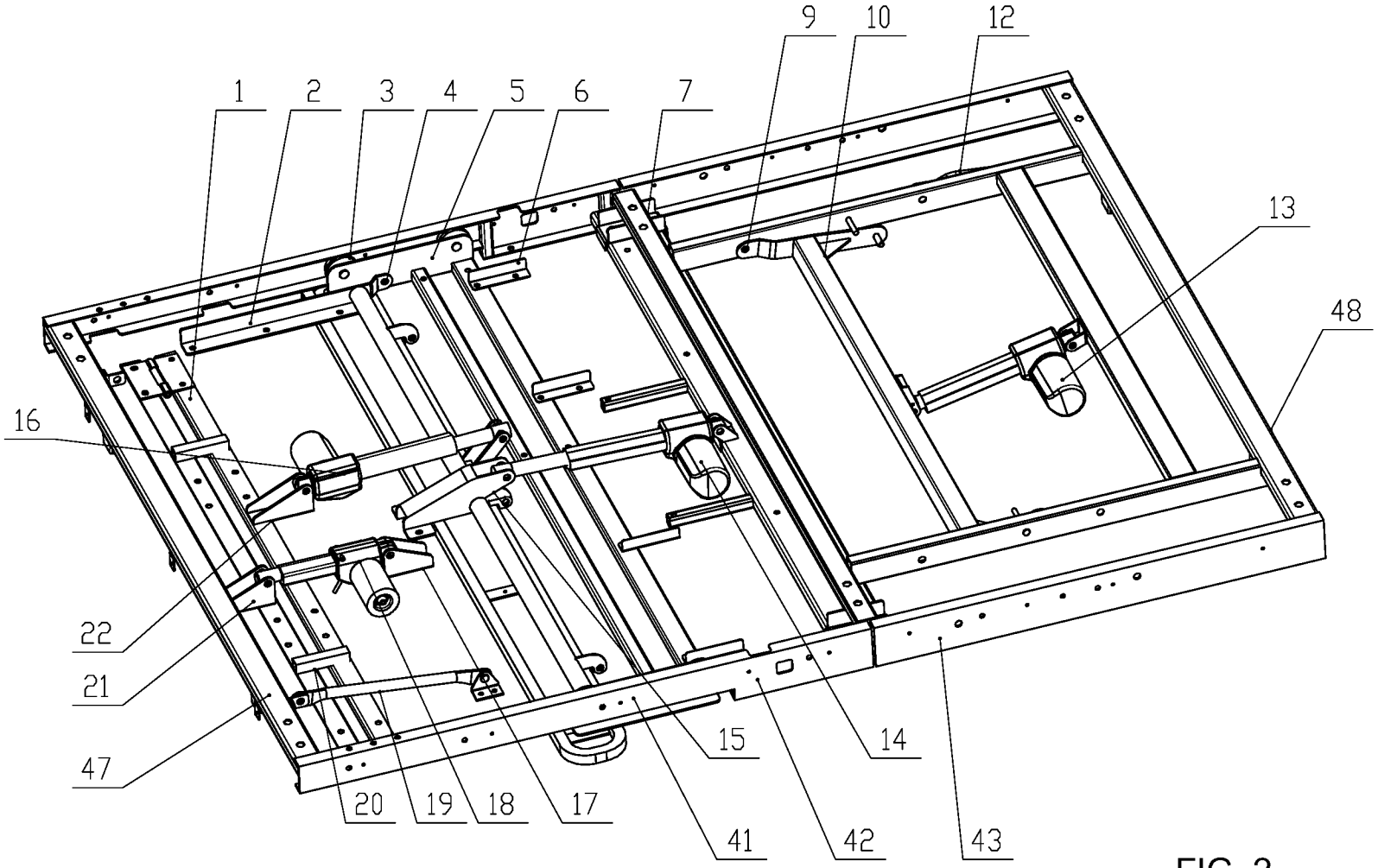
FIG. 2 shows schematically a back perspective view of the structural frame of the adjustable bed shown in FIG. 1.
Figure 3:
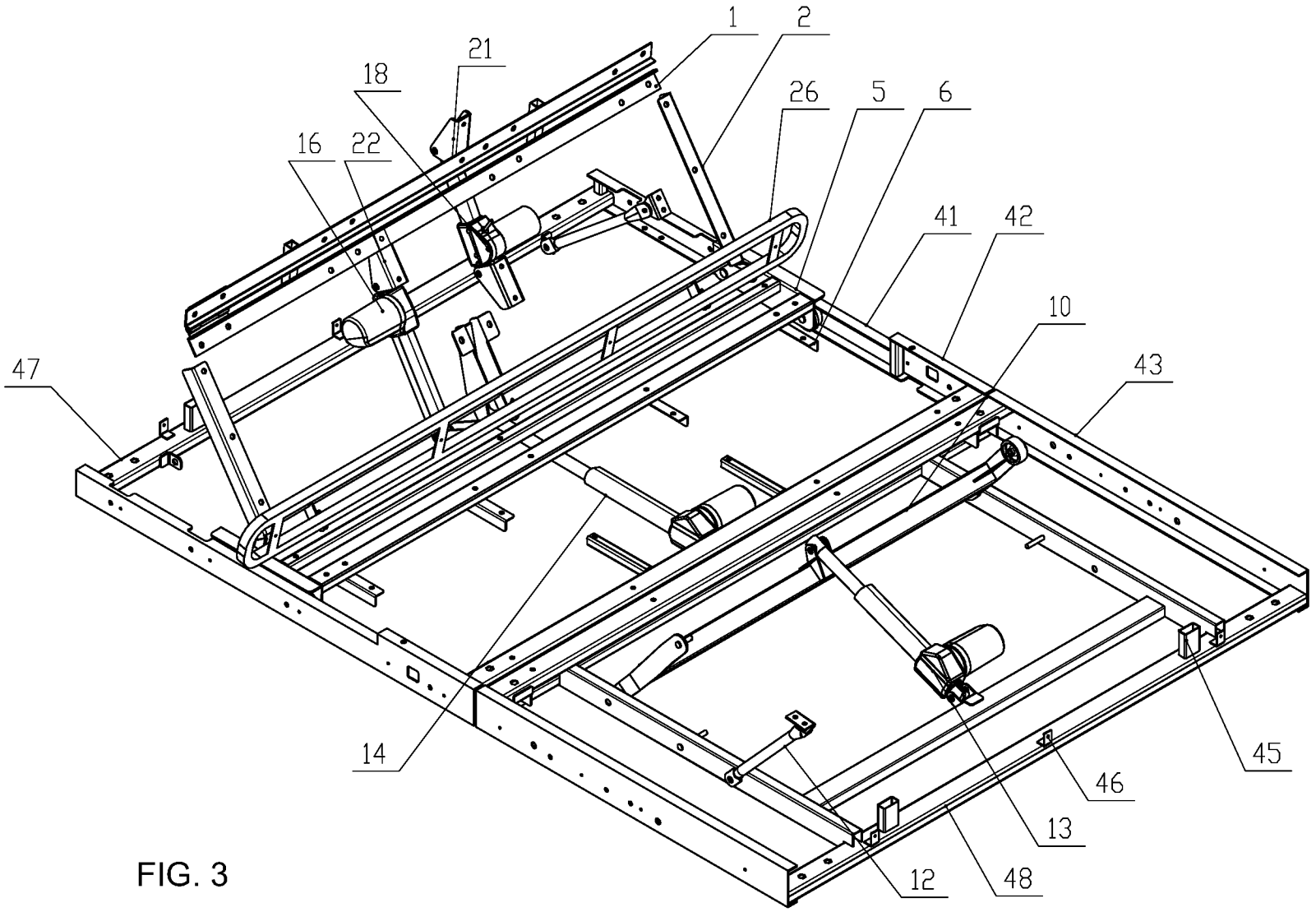
FIG. 3 shows schematically another front perspective view of the structural frame of the adjustable bed shown in FIG. 1.

The invention will now be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

The terms used in this specification generally have their ordinary meanings in the art, within the context of the invention, and in the specific context where each term is used. Certain terms that are used to describe the invention are discussed below, or elsewhere in the specification, to provide additional guidance to the practitioner regarding the description of the invention. For convenience, certain terms may be highlighted, for example using italics and/or quotation marks. The use of highlighting has no influence on the scope and meaning of a term; the scope and meaning of a term is the same, in the same context, whether or not it is highlighted. It will be appreciated that same thing can be said in more than one way. Consequently, alternative language and synonyms may be used for any one or more of the terms discussed herein, nor is any special significance to be placed upon whether or not a term is elaborated or discussed herein. Synonyms for certain terms are provided. A recital of one or more synonyms does not exclude the use of other synonyms. The use of examples anywhere in this specification including examples of any terms discussed herein is illustrative only, and in no way limits the scope and meaning of the invention or of any exemplified term. Likewise, the invention is not limited to various embodiments given in this specification.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the invention.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

It will be understood that when an element is referred to as being "on", "attached" to, "connected" to, "coupled" with, "contacting", etc., another element, it can be directly on, attached to, connected to, coupled with or contacting the other element or intervening elements may also be present. In contrast, when an element is referred to as being, for example, "directly on", "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

As used herein, "around", "about", "substantially" or "approximately" shall generally mean within 20 percent, preferably within 10 percent, and more preferably within 5 percent of a given value or range. Numerical quantities given herein are approximate, meaning that the term "around", "about" "substantially" or "approximately" can be inferred if not expressly stated.

The description will be made as to the embodiments of the invention in conjunction with the accompanying drawings in FIGS. 1-8. In accordance with the purposes of this invention, as embodied and broadly described herein, this invention, in one aspect, relates to an adjustable bed.

Figure 8:
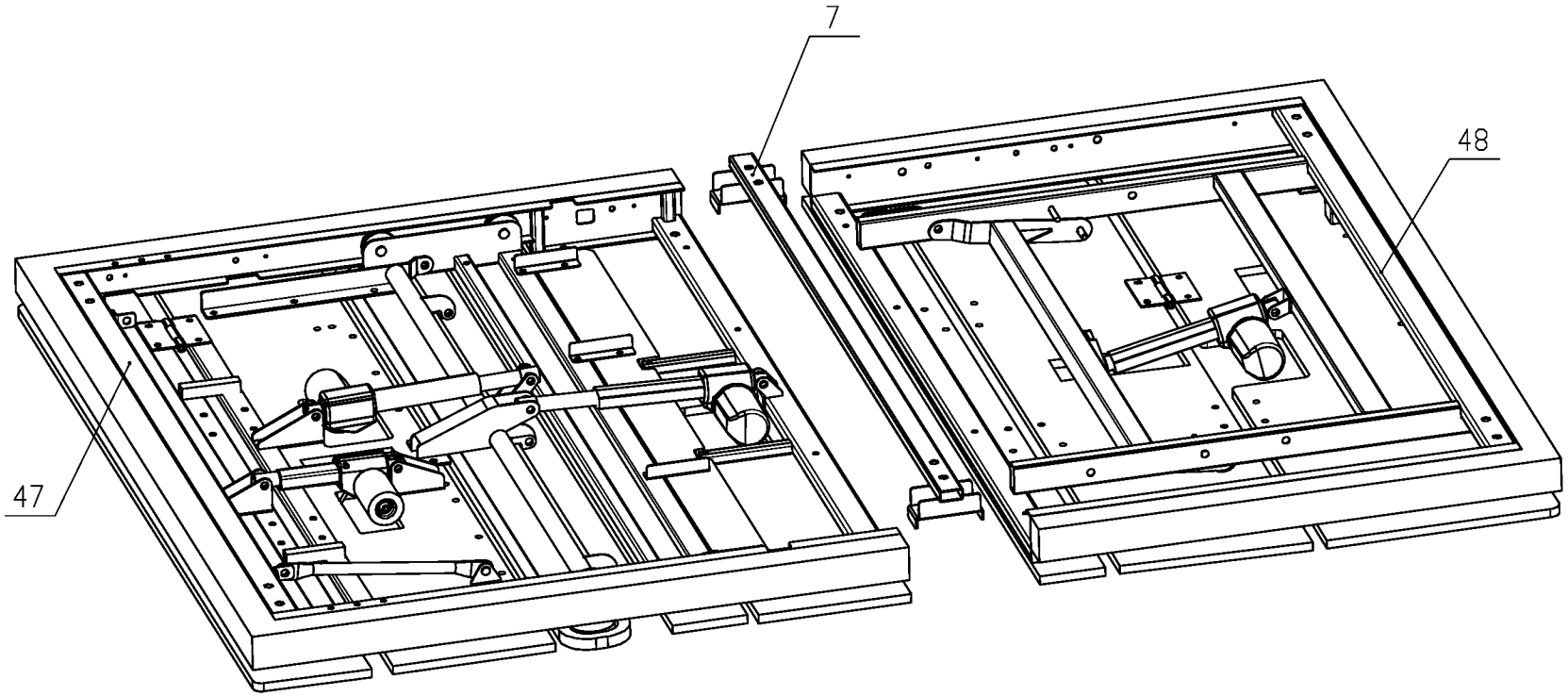
FIG. 8 shows schematically yet another back perspective view of the adjustable bed shown in FIG. 4.

Referring to FIGS. 1-8, an adjustable bed is shown according to one embodiment of the invention. In this exemplary embodiment, the adjustable bed includes a head frame assembly 47, a foot frame assembly 48 and a knockdown connecting bracket 7. Specifically, the head frame assembly 47 includes a head frame upper rail, a head frame lower rail, and a pair of head frame side rails. Each head frame side rail has a lower C steel bracket 41 at an upper end and a higher C steel bracket 42 at a lower end. The adjustable bed further includes an L bracket 46 mounted on the head frame upper rail. The foot frame assembly 48 has a foot frame upper rail, a foot frame lower rail, and a pair of foot frame side rails. In one embodiment, each of the pair of foot frame side rails has a higher C steel bracket 43. The knockdown connecting bracket 7 connects the head frame lower rail of the head frame assembly 47 and the foot frame upper rail of the foot frame assembly 48, as shown in FIG. 8. In this way, the adjustable bed is easy to assemble and transport.

The adjustable bed further includes a slidable assembly 5. The slidable assembly 5 includes a slidable assembly base and a pair of slidable assembly sides. Each of the pair of slidable assembly sides is slidable within one of the pair of lower C steel brackets 41 in a slidable assembly upward direction (i.e., slides toward the head frame upper rail) or a slidable assembly downward direction (i.e., slides toward the head frame lower rail). In one embodiment, a plurality of rolling wheels 3 are mounted at the pair of slidable assembly sides to roll within one of the pair of lower C steel brackets 41 in the slidable assembly upward direction or the slidable assembly downward direction. In one embodiments, the number of rolling wheels 3 mounted at each slidable assembly side is two. It should be noted that other number of rolling wheels 3 mounted at each slidable assembly side could be any other number (e.g., one, three, eight, etc.).

A plurality of slidable assembly angle steels are mounted on the slidable assembly base. In one embodiment, the number of slidable assembly angle steels mounted on the slidable assembly base is four. It should be noted that other number of slidable assembly angle steels mounted on the slidable assembly base could be any other number (e.g., one, two, six, etc.).

The adjustable bed further includes a pair of head lift arm bracket assemblies 2. A first end of each head lift arm bracket assembly 2 is pivotally connected to one of the pair of slidable assembly sides through one of a pair of rotate pivots 4. A second end of each head lift arm bracket assembly 2 is connected to one of two ends of a first head tilt angle bracket 1. A second head tilt angle bracket 1 is hinged with the first head tilt angle bracket 1 through a hinge 11.

The adjustable bed further includes a head tilt platform 23, a head lift platform 24, a lumbar lift bracket assembly 26, an upper seat platform 27, a support platform 44 and a lower seat platform 28. The head tilt platform 23 is mounted on the second head tilt angle bracket 1. The head lift platform 24 is mounted on the first head tilt angle bracket 1 and the pair of head lift arm bracket assemblies 2. Because the second head tilt angle bracket 1 is hinged with the first head tilt angle bracket 1 through the hinge 11, the head tilt platform 23 can rotate relative to the head lift platform 24.

The lumbar lift bracket assembly 26 is pivotally connected to the pair of head lift arm bracket assemblies 2 through a pair of rotate pivots 37. The upper seat platform 27 is mounted on the slidable assembly 5. The support platform 44 is mounted on the plurality of slidable assembly angle steels 6. The lower seat platform 28 is mounted on the higher C steel brackets 42 of the pair of head frame side rails. In terms of height, the support platform 44 is beneath the lower seat platform 28.

The adjustable bed further includes a head support tube 19. The head support tube 19 has an upper end pivotally connected to the L bracket 46 and a lower end connected to the head lift platform 24.

Figure 4:
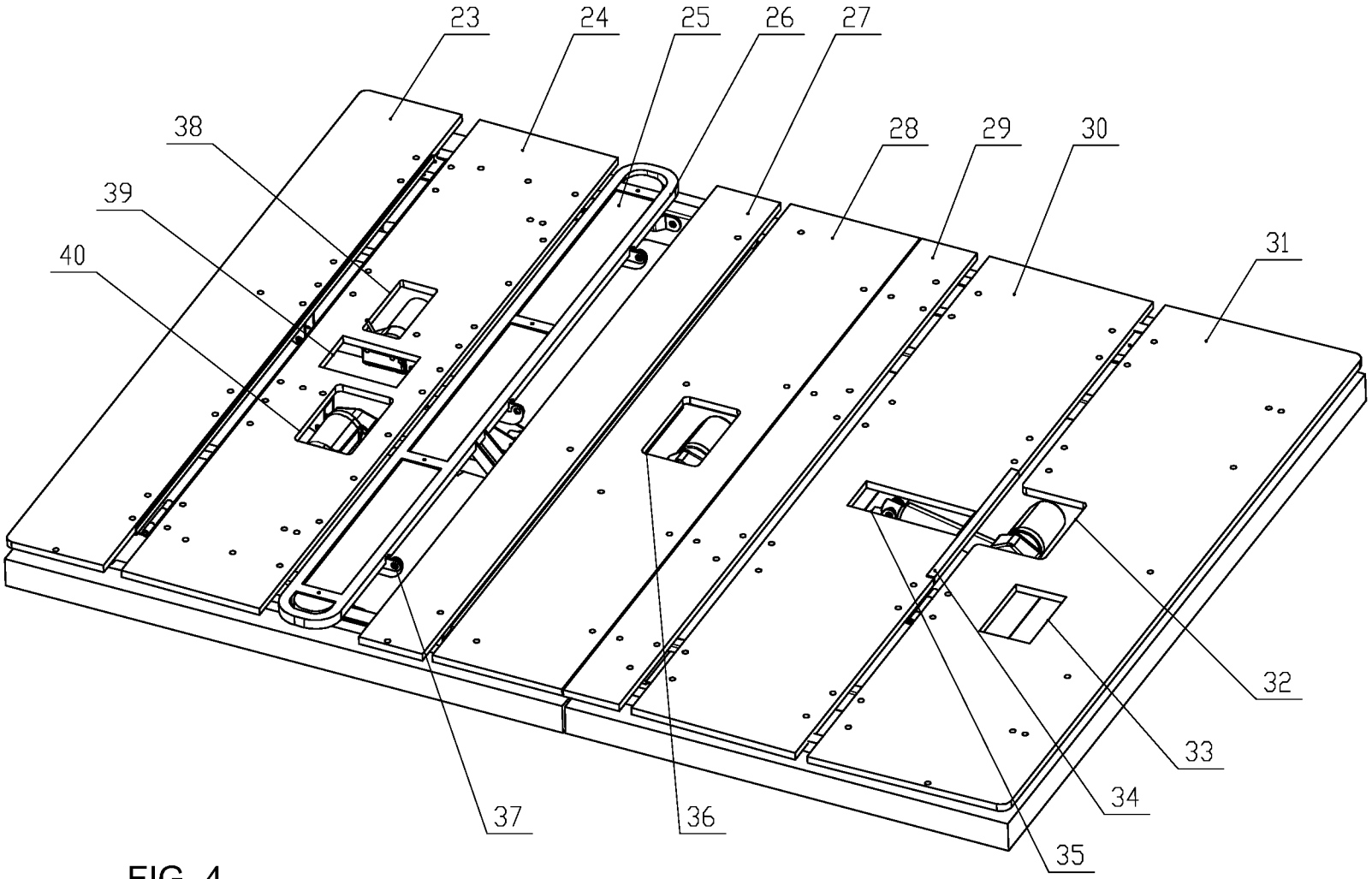
FIG. 4 shows schematically a front perspective view of an adjustable bed according to one embodiment of the invention.
Figure 5:
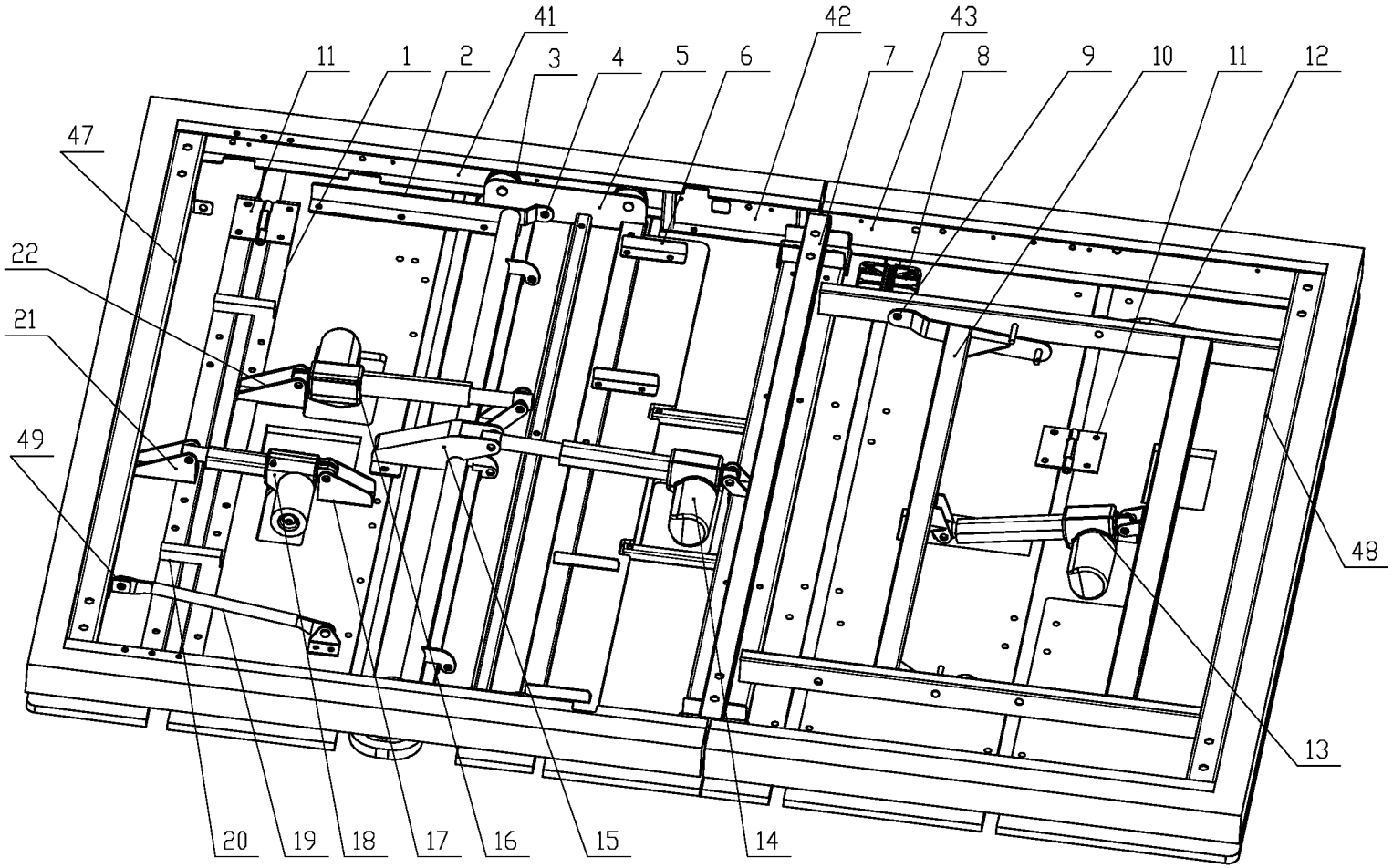
FIG. 5 shows schematically a back perspective view of the adjustable bed shown in FIG. 4.
Figure 6:
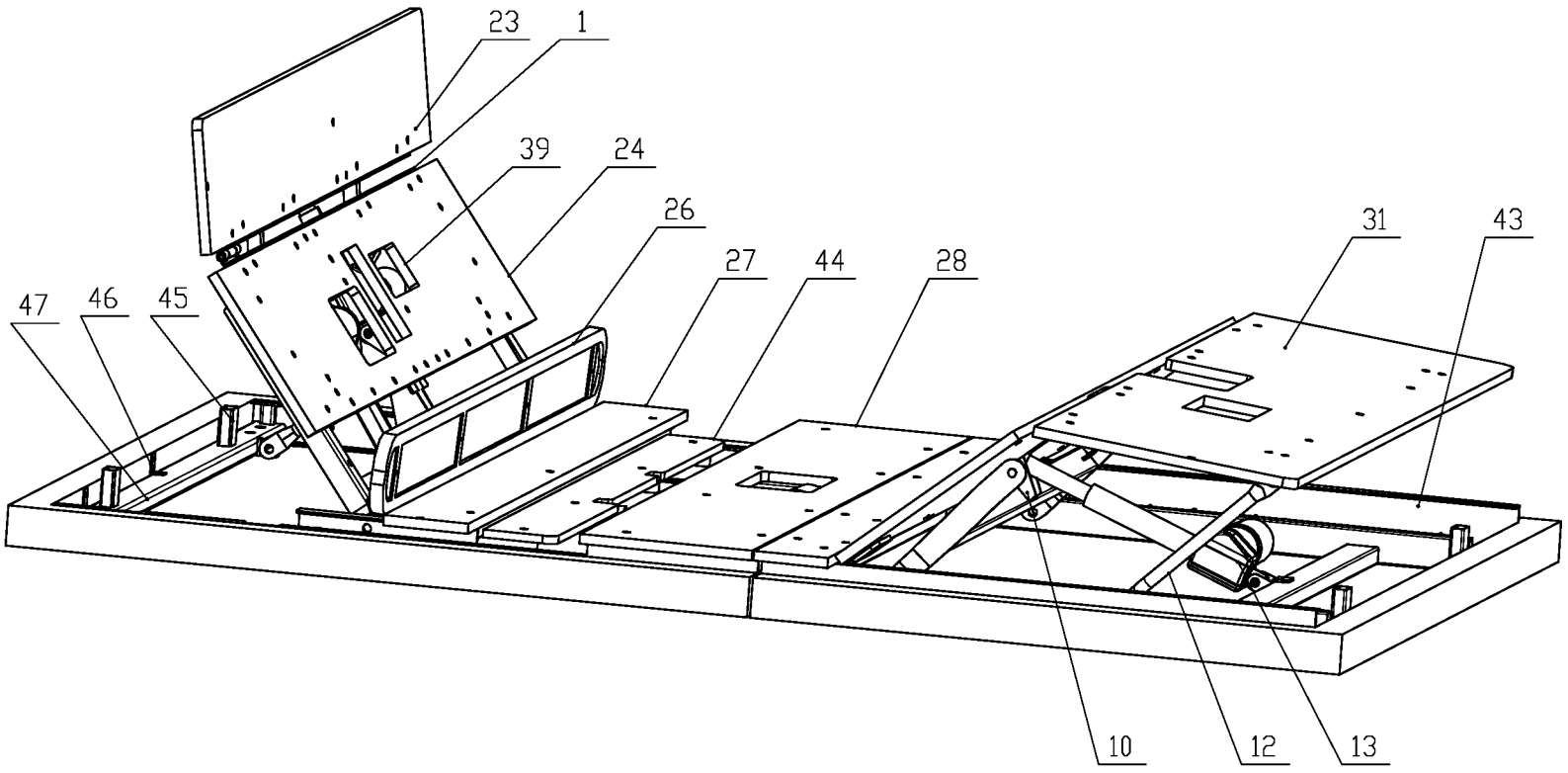
FIG. 6 shows schematically another front perspective view of the adjustable bed shown in FIG. 4.
Figure 7:
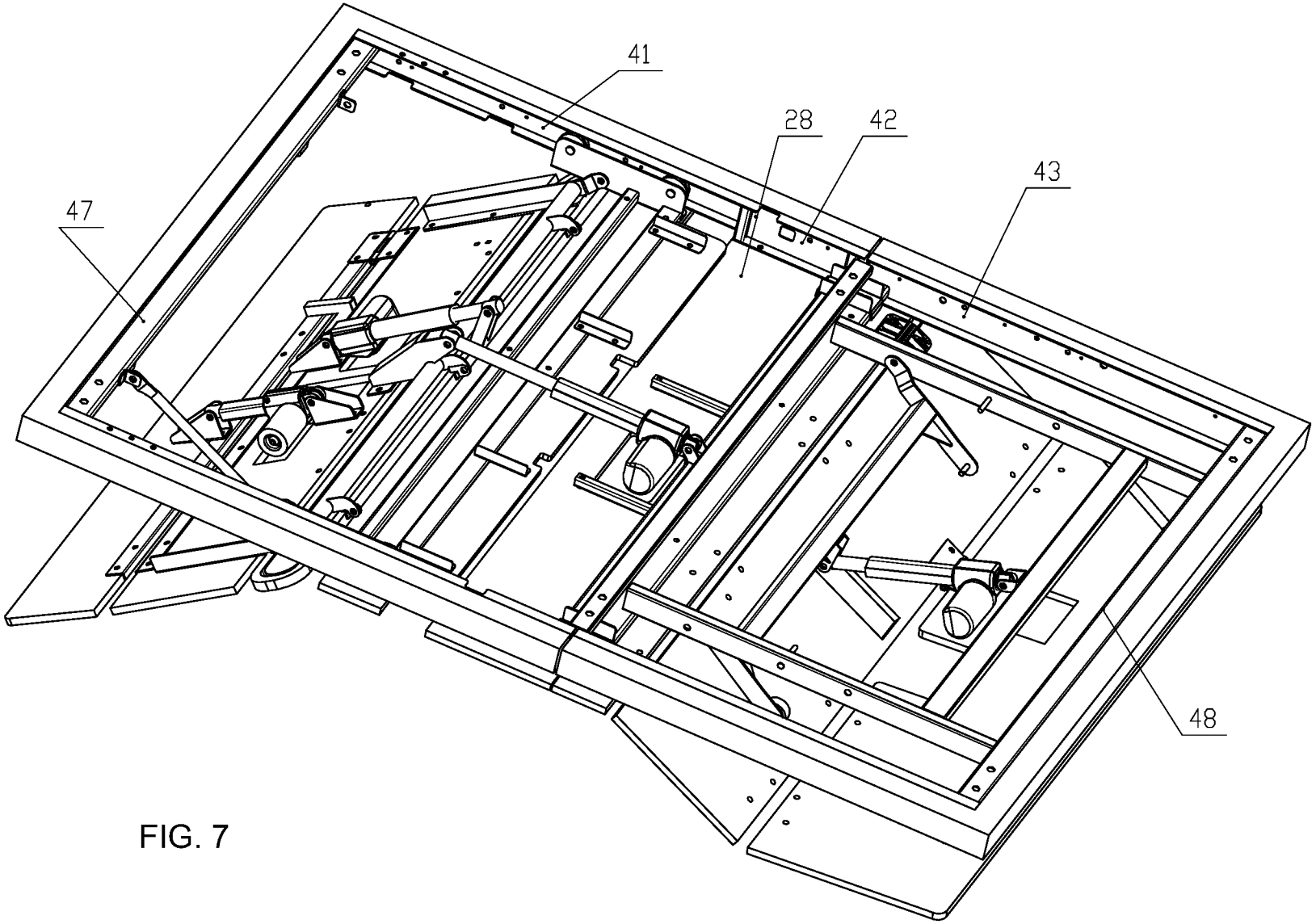
FIG. 7 shows schematically another back perspective view of the adjustable bed shown in FIG. 4.

The adjustable bed further includes a head lift motor 14. The head lift motor 14 is secured to the head frame assembly 47 for driving the pair of head lift arm bracket assemblies 2 in a head lift forward direction (i.e., the head lift arm bracket assemblies 2 are lifted, as shown in FIG. 6) or a head lift backward direction (i.e., the head lift arm bracket assemblies 2 are laid back, as shown in FIG. 4). In one embodiment, the head lift motor 14 is a linear actuator.

When the head lift motor 14 drives the pair of head lift arm bracket assemblies 2 in the head lift forward direction, because of the head support tube 19, the slidable assembly 5 slides in the slidable assembly upward direction. When the head lift motor 14 drives the pair of head lift arm bracket assemblies 2 in the head lift backward direction, because of the head support tube 19, the slidable assembly 5 slides in the slidable assembly downward direction and the support platform 44 is partially beneath the lower seat platform 28.

In other words, when the head lift motor 14 drives the pair of head lift arm bracket assemblies 2 in the head lift forward direction, the head lift platform 24 are lifted, and in the meantime, the upper seat platform 27 and the lower seat platform 28 are gradually separated, therefore extending the length of the adjustable bed. In one embodiment, the gap between the upper seat platform 27 and the lower seat platform 28 has a maximum width of 6.5 inches in the slidable assembly upward direction. In other words, when the upper seat platform 27 and the lower seat platform 28 are separated to the greatest extent, the gap between them has a width of 6.5 inches. In this way, the person who is lying on the adjustable bed won't feel that her abdomen is pressed because the length of the adjustable bed is extended when the upper portion is lifted. As the slidable assembly 5 slides in the slidable assembly upward direction, the support platform 44 slides as well for supporting the person when the upper seat platform 27 and the lower seat platform 28 are gradually separated.

On the other hand, when the head lift motor 14 drives the pair of head lift arm bracket assemblies 2 in the head lift backward direction, the head lift platform 24 are laid back, and in the meantime, the upper seat platform 27 and the lower seat platform 28 are gradually coming closer to each other. Because the support platform 44 is beneath the lower seat platform 28 in terms of height, the support platform 44 is partially beneath the lower seat platform 28. When the head lift motor 14 drives the pair of head lift arm bracket assemblies to a fully laid back position as shown in FIG. 4, the support platform 44 is entirely beneath the lower seat platform 28.

The adjustable bed may further include a lumbar motor 16. The lumbar motor 16 is secured to the head lift platform 24 for driving the lumbar lift bracket assembly 26 in a lumbar lift forward direction (i.e., the lumbar lift bracket assembly 26 is lifted, as shown in FIG. 6) or a lumbar lift backward direction (i.e., the lumbar lift bracket assembly 26 is laid back, as shown in FIG. 4). In this way, the person who is lying on the adjustable bed can adjust the lumbar lift bracket assembly 26 as he desires. In one embodiment, the lumbar motor 16 is a linear actuator.

The adjustable bed may further include a head tilt motor 18. The head tilt motor 18 is secured to the head lift platform 24 for driving the head tilt platform 23 in a head tilt forward direction (i.e., the head tilt platform 23 is lifted, as shown in FIG. 6) or a head tilt backward direction (i.e., the head tilt platform 23 is laid back, as shown in FIG. 4). In this way, the person who is lying on the adjustable bed can adjust the head tilt platform 23 as he desires. In one embodiment, the head tilt motor 18 is a linear actuator.

In one embodiment, a welded tube 20 is welded to the first head tilt angle bracket 1 and protrudes in parallel with the head lift platform 24 toward the second head tilt angle bracket 1. The welded tube 20 prevents the head tilt platform 23 from moving further in the head tilt backward direction when the head tilt platform 23 is in contact with the welded tube 20. In this way, the welded tube 20 reinforces the strength of the head tilt platform 23. In other embodiments, the number of welded tubes 20 may be any number larger than one (e.g., two, three, four, etc.).

The adjustable bed may further include a pair of foot lift arm bracket assemblies 10, a fixed platform 29, a thigh platform 30, a leg platform 31, a foot lift motor 13, a foot support tube 12. Each of the pair of foot lift arm bracket assemblies 10 has a first end which is pivotally connected to the foot frame assembly 48 through one of a pair of rotate pivots 9. A second end of each foot lift arm bracket assembly 10 is a free end. The fixed platform 29 is mounted on the pair of foot frame side rails. The thigh platform 30 is mounted on the pair of foot lift arm bracket assemblies 10. The leg platform 31 is hinged with the thigh platform 30 through a hinge 11. The foot lift motor 13 is secured to the foot frame assembly 48 for driving the pair of foot lift arm bracket assemblies 10 in a foot lift forward direction (i.e., the thigh platform 30 is lifted, as shown in FIG. 6) or a foot lift backward direction (i.e., the thigh platform 30 is laid back, as shown in FIG. 4). In one embodiment, the foot lift motor 13 is a linear actuator. The foot support tube 12 has an upper end pivotally connected to the foot frame assembly 48 and a lower end connected to the leg platform 31.

In one embodiment, the adjustable bed may further include a first opening for motor 36 in the lower seat platform 28 to accommodate the head lift motor 14; a second opening for the motor 38 in the head lift platform 24 to accommodate the head tilt motor 18; a third opening for the motor 40 in the head lift platform 24 to accommodate the lumbar motor 16; a fourth opening for motor 32 in the leg platform 31 to accommodate the foot lift motor 13; and a fifth opening for the motor 35 in the thigh platform 30 to accommodate the foot lift motor 13. When the adjustable bed is fully laid back (as shown in FIG. 4), the first opening for motor 36, the second opening for the motor 38, the third opening for the motor 40, the fourth opening for motor 32 and the fifth opening for the motor 35 accommodate the head lift motor 14, the head tilt motor 18, the lumbar motor 16 and the foot lift motor 13, therefore avoiding collision, increasing thrust angle and lowering the overall height of the adjustable bed.

In one embodiment, the adjustable bed may further include a first massage motor opening hole 39 in the head lift platform 24 and a second massage motor opening hole 33 in the leg platform 31. The a first massage motor opening hole 39 and the second massage motor opening hole 33 can be used for installing massage components as needed.

In one embodiment, the adjustable bed may further include a plurality of head support platform mounting bracket 45 mounted on the head frame upper rail of the head frame assembly 47. In one embodiment, the adjustable bed may further include a plurality of foot support platform mounting bracket 45 mounted on the foot frame lower rail of the foot frame assembly 48.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments were chosen and described in order to explain the principles of the invention and their practical application so as to enable others skilled in the art to utilize the invention and various embodiments and with various modifications as are suited to the particular use contemplated. Alternative embodiments will become apparent to those skilled in the art to which the invention pertains without departing from its spirit and scope. Accordingly, the scope of the invention is defined by the appended claims rather than the foregoing description and the exemplary embodiments described therein.

What is claimed is:

1. An adjustable bed, comprising:

a head frame assembly, having a head frame upper rail, a head frame lower rail, and a pair of head frame side rails, each head frame side rail having a lower C steel bracket at a upper end and a higher C steel bracket at a lower end;

a foot frame assembly, having a foot frame upper rail, a foot frame lower rail, and a pair of foot frame side rails;

a knockdown connecting bracket connecting the head frame lower rail of the head frame assembly and the foot frame upper rail of the foot frame assembly;

an L bracket mounted on the head frame upper rail;

a slidable assembly having a slidable assembly base and a pair of slidable assembly sides, each of the pair of slidable assembly sides is slidable within one of the pair of lower C steel brackets in a slidable assembly upward direction or a slidable assembly downward direction;

a plurality of slidable assembly angle steels mounted on the slidable assembly base;

a pair of head lift arm bracket assemblies, a first end of each head lift arm bracket assembly is pivotally connected to one of the pair of slidable assembly sides through one of a pair of rotate pivots, a second end of each head lift arm bracket assembly is connected to one of two ends of a first head tilt angle bracket;

a second head tilt angle bracket, hinged with the first head tilt angle bracket through a hinge;

a head tilt platform, mounted on the second head tilt angle bracket;

a head lift platform, mounted on the first head tilt angle bracket and the pair of head lift arm bracket assemblies;

a lumbar lift bracket assembly, pivotally connected to the pair of head lift arm bracket assemblies through a pair of rotate pivots;

an upper seat platform, mounted on the slidable assembly;

a support platform, mounted on the plurality of slidable assembly angle steels;

a lower seat platform, mounted on the higher C steel brackets of the pair of head frame side rails;

a head lift motor, secured to the head frame assembly for driving the pair of head lift arm bracket assemblies in a head lift forward direction or a head lift backward direction; and a head support tube, having an upper end pivotally connected to the L bracket and a lower end connected to the head lift platform;

wherein when the head lift motor drives the pair of head lift arm bracket assemblies in the head lift forward direction, the slidable assembly slides in the slidable assembly upward direction, and when the head lift motor drives the pair of head lift arm bracket assemblies in the head lift backward direction, the slidable assembly slides in the slidable assembly downward direction and the support platform is partially beneath the lower seat platform.

2. The adjustable bed of claim 1, further comprising:

a lumbar motor, secured to the head lift platform for driving the lumbar lift bracket assembly in a lumbar lift forward direction or a lumbar lift backward direction.

3. The adjustable bed of claim 2, further comprising:

a head tilt motor, secured to the head lift platform for driving the head tilt platform in a head tilt forward direction or a head tilt backward direction.

4. The adjustable bed of claim 3, further comprising:

a first opening for a motor in the lower seat platform to accommodate the head lift motor;

a second opening for a motor in the head lift platform to accommodate the head tilt motor; and a third opening for a motor in the head lift platform to accommodate the lumbar motor.

5. The adjustable bed of claim 3, wherein the head lift motor, the head tilt motor, and the lumbar motor are linear actuators.

6. The adjustable bed of claim 1, further comprising:

a welded tube, welded to the first head tilt angle bracket and protruding in parallel with the head lift platform toward the second head tilt angle bracket, preventing the head tilt platform from moving further in the head tilt backward direction when the head tilt platform is in contact with the welded tube.

7. The adjustable bed of claim 1, further comprising:

a plurality of rolling wheels, mounted at the pair of slidable assembly sides to roll within one of the pair of lower C steel brackets in the slidable assembly upward direction or the slidable assembly downward direction.

8. The adjustable bed of claim 1, further comprising:

a pair of foot lift arm bracket assemblies, a first end of each foot lift arm bracket assembly is pivotally connected to the foot frame assembly through one of a pair of rotate pivots, a second end of each foot lift arm bracket assembly is a free end;

a fixed platform, mounted on the pair of foot frame side rails;

a thigh platform, mounted on the pair of foot lift arm bracket assemblies;

a leg platform, hinged with the thigh platform through a hinge;

a foot lift motor, secured to the foot frame assembly for driving the pair of foot lift arm bracket assemblies in a foot lift forward direction or a foot lift backward direction; and a foot support tube, having an upper end pivotally connected to the foot frame assembly and a lower end connected to the leg platform.

9. The adjustable bed of claim 8, wherein each of the pair of foot frame side rails has a higher C steel bracket.

10. The adjustable bed of claim 8, further comprising:

a fourth opening for a motor in the leg platform to accommodate the foot lift motor; and a fifth opening for a motor in the thigh platform to accommodate the foot lift motor.

11. The adjustable bed of claim 8, further comprising:

a second massage motor opening hole in the leg platform.

12. The adjustable bed of claim 8, wherein the foot lift motor is a linear actuator.

13. The adjustable bed of claim 1, further comprising:

a first massage motor opening hole in the head lift platform.

14. The adjustable bed of claim 1, further comprising:

a plurality of head support platform mounting brackets mounted on the head frame upper rail of the head frame assembly.

15. The adjustable bed of claim 1, further comprising:

a plurality of foot support platform mounting brackets mounted on the foot frame lower rail of the foot frame assembly.

* * * * *